United States Patent [19]

Krumm

[11] 4,433,966

[45] Feb. 28, 1984

[54] DIAPHRAGM PUMP

[75] Inventor: Klaus D. Krumm, Bühl, Fed. Rep. of Germany

[73] Assignee: Luk Lamellen und Kupplungsbau GmbH, Bühl, Fed. Rep. of Germany

[21] Appl. No.: 326,564

[22] Filed: Dec. 2, 1981

[30] Foreign Application Priority Data

Dec. 6, 1980 [DE] Fed. Rep. of Germany ..... 3046028

[51] Int. Cl.[3] ..... F04B 39/02; F04B 21/02; F01B 19/02

[52] U.S. Cl. ..... 417/571; 92/100

[58] Field of Search ..... 417/413, 471, 571; 92/100

[56] References Cited

U.S. PATENT DOCUMENTS

| | | | |
|---|---|---|---|
| 2,236,244 | 3/1941 | Cornelius | 417/413 |
| 2,285,215 | 6/1942 | Lotz | 417/413 |
| 2,463,766 | 3/1949 | Hadley | 417/413 |
| 2,687,696 | 8/1954 | Theis | 92/100 |
| 2,803,265 | 8/1957 | Coffey | 417/471 |
| 2,819,013 | 1/1958 | Paasche | 92/100 |
| 2,834,299 | 5/1958 | Coffey | 417/471 |
| 2,904,876 | 9/1959 | Edelen | 92/100 |

*Primary Examiner*—William L. Freeh

*Attorney, Agent, or Firm*—Kontler, Grimes & Battersby

[57] ABSTRACT

A diaphragm pump wherein the lower portion of an upright housing surrounds an eccentric extending into the annular lower end portion of the one-piece connecting rod the upper end portion of which extends through the central openings of two discs flanking the apertured central portion of a flexible diaphragm whose marginal portion is sealingly clamped between the main housing portion and a cover overlying the diaphragm. The top part of the upper end portion of the connecting rod is deformed to constitute a rivet head which sealingly fills the opening of at least one disc and urges the discs as well as the central portion of the diaphragm against the S-shaped surface of a carrier forming part of the connecting rod and serving to support the underside of the adjacent disc. The cover carries a first valve which opens when the diaphragm is flexed downwardly to admit a fluid into a pump chamber at the upper side of the diaphragm, and a second valve which opens the diaphragm is flexed upwardly to discharge a metered quantity of fluid from the chamber. The lower portion of the housing constitutes an oil sump for the eccentric, for the lower end portion of the connecting rod and for the shaft which drives the eccentric by way of a freewheel. The supply of oil in the sump can be replenished by way of a normally sealed port in the lower portion of the housing.

19 Claims, 4 Drawing Figures

DIAPHRAGM PUMP

BACKGROUND OF THE INVENTION

The present invention relates to pumps in general, and more particularly to improvements in diaphragm pumps. Still more particularly, the invention relates to improvements in diaphragm pumps of the type wherein a portion of the diaphragm is flexed back and forth so as to alternately draw and expel a fluid medium from a pumping chamber.

Diaphragm pumps are often utilized to convey metered quantities of fuel or another fluid as well as to serve as so-called vacuum pumps. Reference may be had to French Pat. No. 7,808,069 which discloses a diaphragm pump with an inlet valve and an outlet valve. The diaphragm is flexed back and forth by a rather complex connecting rod which receives motion from a crankshaft and flexes the diaphragm in such a way that the inlet valve opens and admits a supply of fluid when the diaphragm is flexed in one direction whereupon the inlet valve closes and the outlet valve opens in response to increasing pressure in the pumping chamber when the diaphragm is flexed in the opposite direction. In other words, the inlet valve opens when the pressure in the pumping chamber decreases as a result of an increase of the volume of such chamber, and the outlet valve opens automatically in response to increasing pressure in the pumping chamber as a result of a reduction of the volume of such chamber. A drawback of the patented diaphragm pump is that it comprises a substantial number of in part highly complex components. Another drawback of the patented pump is that its components are not readily accessible, and also that the pump must be opened or at least partially dismantled from time to time in order to allow for proper lubrication of certain rotary and/or other components.

OBJECTS AND SUMMARY OF THE INVENTION

An object of the invention is to provide a novel and improved diaphragm pump which is simpler, more rugged and less expensive than but at least as reliable and as versatile as presently known diaphragm pumps.

Another object of the invention is to provide a diaphragm pump with novel and improved means for reciprocating a portion of its diaphragm.

A further object of the invention is to provide a novel and improved connecting rod for use in the means for flexing the diaphragm of the above outlined pump.

Still another object of the invention is to provide a diaphragm pump wherein all such parts which are not readily accessible can be lubricated for extended periods of time without necessitating extensive or even partial dismantling of the machine.

A further object of the invention is to provide novel and improved means for coupling the diaphragm of a diaphragm pump with the means which flexes the diaphragm when the pump is in use.

A further object of the invention is to provide a diaphragm pump which can be used as a superior and less expensive substitute for presently known diaphragm pumps in automotive vehicles or in other types of machines which employ internal combustion engines.

Still another object of the invention is to provide a diaphragm pump which can be assembled or taken apart within a fraction of the time that is necessary to carry out similar operations in connection with conventional diaphragm pumps.

One feature of the invention resides in the provision of a diaphragm pump which comprises a housing, a flexible diaphragm which is installed in the housing and includes an apertured central portion, and novel and improved means for flexing the diaphragm. The flexing means comprises a rotary eccentric in the housing (preferably in the lower portion of the housing), a one-piece connecting rod having an annular first end portion which surrounds the eccentric, a carrier which is remote from the first end portion, and a second end portion which extends from the carrier and through the aperature in the central portion of the diaphragm. The flexing means further comprises a substantially disc-shaped biasing element having a central opening through which the second end portion of the connecting rod extends. The central portion of the diaphragm is disposed between the biasing element and the carrier, and the second end portion of the connecting rod includes a part which is outwardly adjacent to the biasing element and serves to urge the biasing element and the central portion of the diaphragm toward the carrier of the connecting rod.

The housing includes a portion which defines with the diaphragm a variable-volume pumping chamber, and the connecting rod serves to flex the diaphragm in first and second directions in response to rotation of the eccentric whereby the diaphragm respectively increases and reduces the volume of the pumping chamber in response to flexing in the first and second directions. The pump further comprises first and second valve means provided on the aforementioned housing portion and respectively arranged to open in response to an increase and a reduction of the volume of the chamber. This enables the first valve means to admit a fluid (e.g., a liquid fuel) into the pumping chamber when the volume of the chamber increases, and the second valve discharges a preselected (metered) quantity of fluid from the pumping chamber in response to a reduction of the volume of the chamber.

The flexing means preferably further comprises a second substantially disc-shaped biasing element having a central opening through which the second end portion of the connecting rod extends. The second biasing element is disposed between the carrier and the central portion of the diaphragm.

The aforementioned part of the second end portion of the connecting rod can constitute a rivet head, i.e., the outer part of the second end portion of the connecting rod can be deformed so as to fill the central opening or openings of the disc-shaped biasing element(s) and to urge such element(s) as well as the central portion of the diaphragm against the carrier. Such carrier can have an elongated supporting surface against which the second biasing element abuts. In order to increase the area of contact between the carrier and the second biasing element, the supporting surface of the carrier can have an undulate shape.

The novel features which are considered as characteristic of the invention are set forth in particular in the appended claims. The improved pump itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2*b* is a top plan view of the connecting rod as seen in the direction of arrow A shown in FIG. 2*a.

DESCRIPTION OF THE PREFERRED EMBODIMENTS

Figure 1:
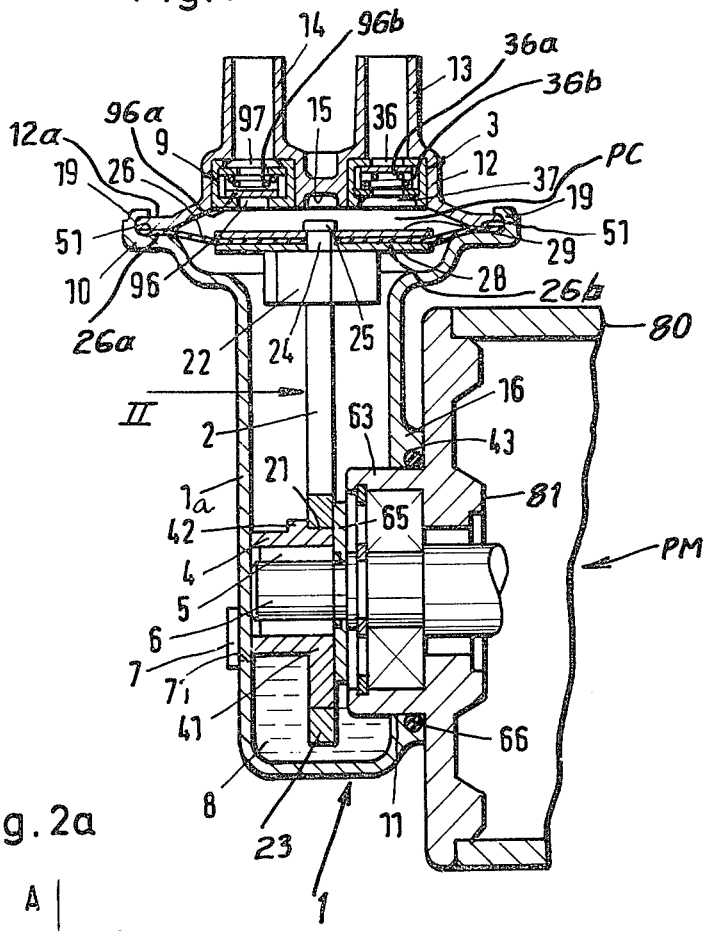
FIG. 1 is a fragmentary vertical sectional view of a motor-pump aggregate which embodies one form of the improved diaphragm pump, the pump being shown in a central vertical sectional view.
Figure 3:
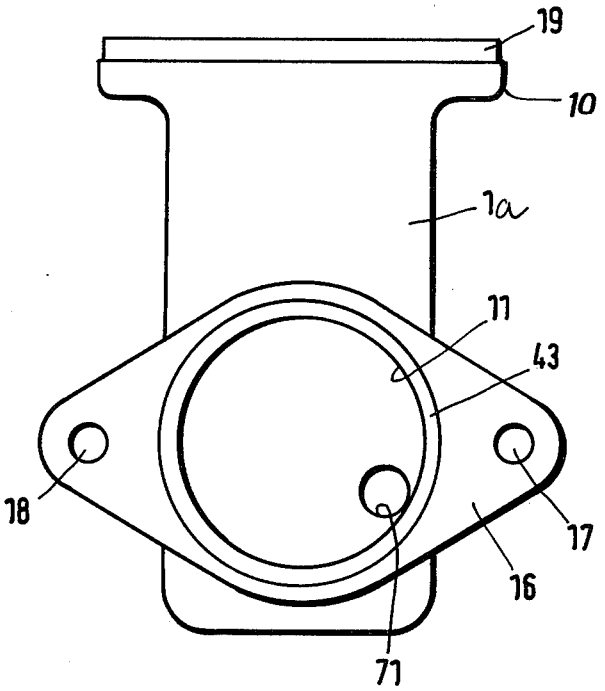
* and FIG. 3 is a front elevational view of the lower portion of the pump housing which is detached from the housing of the prime mover for the eccentric which drives the connecting rod.

Referring first to FIG. 1, the improved diaphragm pump comprises a housing 1 including a main or lower portion 1*a* and an upper portion or cover 12. As can be seen in FIG. 3, the lower portion 1*a* of the housing 1 flares upwardly and outwardly at its upper end where it is sealingly connected to the cover 12. The uppermost part of the lower housing portion 1*a* constitutes a flange 10 having a relatively thin marginal portion 19 which surrounds a complementary flange 12*a* at the lower end of the cover 12. By reducing the thickness of the marginal portion 19, the latter can be more readily flexed around the adjacent marginal portion of the flange 12*a*. The flanges 10 and 12*a* extend substantially radially of the major or lower portion 1*a* of the housing 1.

The housing 1 confines a substantially (but not necessarily) circular flexible diaphragm 26 which consists of rubber or an elastomeric synthetic plastic material and the marginal portion 26*a* of which constitutes a bead extending into an annular groove 51 formed at the underside of the flange 12*a* of the cover 12. The marginal portion 26*a* is clamped between the flanges 10 and 12*a* so that it is prevented from slipping into the interior of the housing 1; in addition, such marginal portion establishes a fluidtight seal beween the flanges 10 and 12*a*. In order to reinforce the diaphragm 26, its elastomeric material can contain one or more layers of textile material. The clamping action of the flanges 10 and 12*a* upon the marginal portion 26*a* of the diaphragm 26 is preferably such that the groove 51 is filled with the elastomeric material to thus ensure proper retention of marginal portion 26*a* against extraction from the space between the two flanges even if the flexing of central portion 26*b* of the diaphragm 26 involves the application of substantial tensional stresses upon the elastomeric and reinforcing materials of the diaphragm. The upper housing portion or cover 12 comprises or carries two valves including an inlet valve or fluid admitting valve 3 and an outlet valve or fluid discharging valve 9. The inlet valve 3 draws a fluid by way of a suction pipe 13 which can be connected to a suitable source of fluid, for example, to a fuel tank, and opens in automatic response to an expansion or increase in volume of a pumping chamber PC which is defined by the diaphragm 26 and the cover 12. The other valve 9 closes in automatic response to an increase in volume of the pumping chamber PC but opens automatically when the volume of this chamber decreases. In other words, the valve 3 admits fluid into the chamber PC when the central portion 26*b* of the diaphragm 26 is flexed in a first direction (downwardly, as viewed in FIG. 1), and the valve 9 discharges a metered quantity of fluid from the chamber PC when the central portion 26*b* of the diaphragm 26 is flexed in the opposite direction (upwardly, as viewed in FIG. 1). The reference character 14 denotes a fluid discharging pipe which receives fluid from the chamber PC by way of outlet valve 9 when the central portion 26*b* of the diaphragm 26 is caused to perform an upward stroke.

The valve 3 has a seat 36 which is adjacent to a plate-like valving element 36*a* normally biased against the seat by a coil spring 36*b*. When the pressure in the chamber PC drops below the pressure in the suction pipe 13, the valving element 36*a* descends against the opposition of the spring 36*b* so that the fluid can flow from the source by way of the suction pipe 13, through the central opening of the seat 36 and the opening 37 of the valve 3, and into the chamber PC.

The outlet valve 9 has a seat 96 which is adjacent to the chamber PC and is normally sealed by a plate-like valving element 96*a* biased downwardly by a coil spring 96*b*. When the pressure in the chamber PC increases above the pressure in the fluid discharging pipe 14, the valving element 96*a* is lifted above the seat 96 against the opposition of the spring 96*b* whereby a metered quantity of the contents of the chamber PC can issue from the housing 1 by way of a central opening of the seat 96 and an opening 97 of the valve to flow into the fluid discharging pipe 14 and thence to the consumer.

Figure 2A:
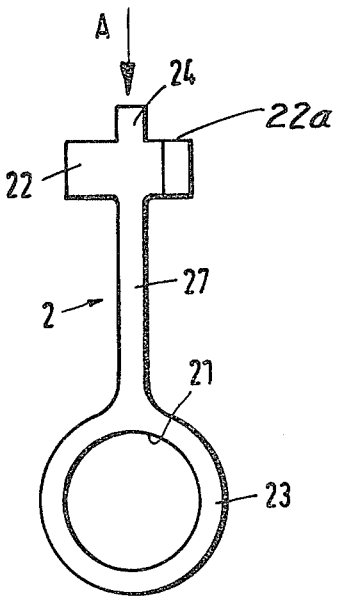
FIG. 2*a* is an end elevational view of the connecting rod in the diaphragm pump of FIG. 1, as seen in the direction of the arrow II in FIG. 1.
Figure 2B:
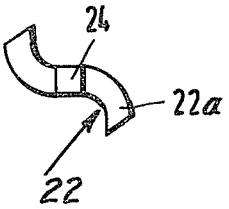

The means for flexing the diaphragm 26 between the upper and lower end positions in which the volume of the pumping chamber PC is respectively reduced to a minimum value and increased to a maximum value comprises an eccentric 4 which is mounted on the output shaft 6 of a prime mover PM constituting a starter motor in an internal combustion engine. The flexing means further comprises a one-piece connecting rod 2 the details of which are illustrated in FIGS. 2*a* and 2*b*. This connecting rod can constitute a one-piece stamping or an otherwise fabricated preform consisting of sheet metal. As shown in FIG. 2*a*, the connecting rod 2 comprises a first or lower end portion 23 which is an annulus defining a circular opening 21 for the corresponding portion of the eccentric 4 on the output shaft 6. The connecting rod 2 further comprises an elongated median portion 27 which connects the annular portion 23 with a carrier 22, and a second end portion 24 which extends upwardly from and beyond the carrier 22. The end portion 24 assumes the shape shown in FIG. 2*a* or 2*b* prior to deformation of its uppermost part, namely, prior to conversion of such uppermost part into a rivet head 25 shown in FIG. 1. The median portion 27 and the end portion 24 have a square or rectangular cross-sectional outline (see the outline of the end portion 24 in FIG. 2*b*). The carrier 22 is preferably deformed (bent) so as to assume an undulate shape resembling the letter S (see FIG. 2*b*). This ensures that the upper side of the carrier 22 provides a relatively large supporting surface 22*a* for the underside of a substantially circular disc-shaped biasing or clamping element 28 having a centrally located opening (not specifically identifed but shown in FIG. 1) for the second end portion 24 of the connecting rod 2. The central opening of the biasing element 28 registers with a similar central opening of a second biasing element 29 which is a substantially circular metallic disc overlying the central portion 26*b* of the diaphragm 26. The openings of the biasing elements 28 and 29 register with an apperture in the central portion 26*b* of the diaphragm 26. When the top portion or part of the end portion 24 of the connecting rod 2 is deformed to constitute the rivet head 25 shown in FIG. 1, it urges the underside of the upper biasing element 29 against the upper side of the central portion 26*b* of the diaphragm 26, and it simultaneously urges the underside of the central portion 26*b* against the upper side of the lower biasing element 28 as well as the underside of the element 28 against the supporting surface 22*a* of the carrier 22. The longitudinal direction of the surface 22*a* extends at right angles to the longitudinal extension of the connecting rod 2, and more particularly of the elongated median portion 27 of the connecting rod. A relatively large supporting surface 22*a* is desirable and advantageous because it reduces the likelihood of tilting of the lower biasing element 28 with reference to the carrier 22. Such tendency to tilt is further reduced by imparting to the surface 22*a* an undulate shape as shown in FIG. 2*b*. The extent of deformation of the end portion 24 during the making of the rivet head 25 is preferably such that the lower part of the end portion 24 completely fills and thereby seals the central opening of the upper biasing element 29 and/or the central opening of the lower biasing element 28. This further reduces the likelihood of penetration of conveyed fluid from the pumping chamber PC into the interior of the lower or main portion 1*a* of the pump housing 1.

In attaching the diaphragm 26 to the connecting rod 2, the connecting rod is slipped onto the eccentric 4 and the disc-shaped lower biasing element 28 is placed onto the supporting surface 22*a* of the carrier 22. In the next step, the end portion 24 (which is still undeformed, namely, in a condition as shown in FIG. 2*a*) is introduced through the aperture of the central portion 26*b* of the diaphragm 26 and thereupon into and upwardly through and beyond the central opening of the upper biasing element 29. In the final step, the top part of the end portion 24 is deformed to constitute the rivet head 25 which biases the parts 29, 26*b*, 28 against each other and against the supporting surface 22*a*. The tool which is used to form the rivet head 25 may be of any conventional design and, therefore, such tool is not shown in the drawing.

In order to reduce the useless portion of the pumping chamber PC to a minimum or to zero, the underside of the cover 12 of the pump housing 1 is preferably formed with a centrally located recess or socket 15 which is in register with and receives the rivet head 25 when the connecting rod 2 causes the diaphragm 26 to complete its upward stroke. At such time, the capacity or volume of the pumping chamber PC is or can be zero or close to zero. It goes without saying that the rivet head 25 constitutes but one form of means for biasing the elements 28, 29 and the central portion 26*b* of the diaphragm 26 toward the supporting surface 22*a* of the carrier 22. For example, the end portion 24 of the connecting rod 2 can be formed with a transversely extending bore for a pin which is inserted into the bore after the biasing elements 28, 29 are assembled with the central portion 26*b* of the diaphragm 26 is a manner as shown in FIG. 1 so that the pin then urges the upper biasing element 29 against the adjacent portion of the diaphragm 26.

FIG. 1 shows the central portion 26*b* of the diaphragm 26 in its lower end position, namely, in a position in which the volume of the pumping chamber PC is increased to its maximum value and the rivet head 25 is located at a level below and is spaced apart from the recess 15 at the underside of the cover 12.

The exact construction of the prime mover PM which includes the shaft 6 serving to drive the eccentric 4 through the medium of a freewheel 5 forms no part of the present invention. This prime mover comprises a housing or casing 80 which is separably connected with the lower portion 1*a* of the pump housing 1. The freewheel 5 between the eccentric 4 and the output shaft 6 constitutes an optional feature of the means for transmitting motion to the connecting rod 2. All that counts is to ensure that the eccentric 4 is set in rotary motion and thereby causes the carrier 22 of the connecting rod 2 to move up and down in order to reduce and increase the volume of the pumping chamber PC at a frequency which is determined by the RPM of the shaft 6.

The eccentric 4 is held against axial movement on the output shaft 6 in that one of its end faces abuts against the adjacent internal surface of the lower portion 1*a* of the pump housing 1. The other end face of the eccentric 4 abuts against a disc-shaped stop 65 which surrounds the output shaft 6 in the interior of the housing portion 1*a*. The stop 65 is held against axial movement relative to the shaft 6 in a manner not shown in detail in FIG. 1 of the drawing. The annular end portion 23 of the connecting rod 2 is held against axial movement with reference to the portion 41 of the eccentric 4 by a radial extension 42 which forms part of the eccentric and can but need not constitute a circumferentially complete collar at the periphery of the eccentric. The other end face of the annular end portion 23 abuts against the stop 65 on the shaft 6.

FIG. 3 shows that the lower portion 1*a* of the pump housing 1 has a flange 16 which defines an opening 11 surrounded by a ring-shaped recess or groove 43. The flange 16 has holes or bores 17 and 18 for screws, bolts or analogous fasteners (not specifically shown) which separably secure the flange 16 to the adjacent portion of the housing or casing 80, namely, to an end wall 81 shown in FIG. 1. The arrangement is such that, when the flange 16 is properly bolted or otherwise secured to the end wall 81, a cylindrical portion 63 of the end wall 81 extends through the opening 11 of the flange 16 and into the interior of the lower portion 1*a* of the pump housing 1 so as to be located at the right-hand side of the stop 65 on the shaft 6. The groove 43 receives a sealing ring 66 which is deformed in response to proper attachment of the flange 16 to the end wall 81 whereby the ring 66 prevents the flow of fluid along the periphery of the cylindrical portion 63 into or from the interior of the lower portion 1*a* of the pump housing 1.

The lowermost part of the space in the lower portion 1*a* of the pump housing 1 preferably contains a supply of suitable lubricant, e.g., oil, which constitutes an oil sump 8 shown in FIG. 1. The quantity of lubricant in the housing portion 1*a* is selected in such a way that it enables at least a portion of each of the parts 23, 5, 4 and 6 to dip into the lubricant so that such parts are properly lubricated for extensive periods of time. In order to avoid the need for even partial dismantling of the structure shown in FIG. 1 when the supply of lubricant in the sump 8 is exhausted or reduced below the permissible minimum level, the housing portion 1*a* is preferably formed with at least one filling port 71 (see also FIG. 3) which is normally sealed by a removable plug 7 (for example, the plug 7 can resemble a screw having an externally threaded shank which meshes with threads in the port 71). Thus, when an attendant wishes to replenish the supply of lubricant in the sump 8, the plug 7 is removed and the requisite amount of oil or another lubricant is introduced into the housing portion 1*a*. If desired, the lower portion 1*a* of the housing 1 can be provided with a window which allows for inspection of the upper level of the supply of lubricant therein.

An important advantage of the improved diaphragm pump is its simplicity. Such simplicity is attributable, to a considerable extent, to the fact that the connecting rod 2 constitutes a one-piece component which can be mass-produced by stamping or an analogous inexpensive technique. Moreover, it is not necessary to provide discrete or separate fastener means for connecting the upper end portion of the connecting rod 2 with the biasing elements 28, 29 and with the central portion 26*b* of the diaphrapm 26. Instead, the top part of the end portion 24 is simply deformed in a manner as shown at 25 to provide a more or less permanent connection between the connecting rod 2 on the one hand and the biasing elements 28, 29 and central portion 26*b* on the other hand. If desired, the lower biasing element 28 can constitute or be made an integral part of the carrier 22.

Another advantage of the improved connecting rod 2 and of the diaphragm pump which embodies such connecting rod is that the end portion 24 can be readily deformed so as to seal the central opening of the biasing element 28 and/or 29 and to thus automatically prevent leakage of conveyed fluid from the pumping chamber PC into the interior of the lower portion 1*a* of the pump housing 1. In other words, the connecting rod 2 can constitute not only a means for flexing the central portion 26*b* of the diaphragm 26 back and forth for the purpose of increasing or reducing the volume of the pumping chamber PC, but the connecting rod can also constitute a means for establishing a seal between the central portion 26*b* of the diaphragm 26 and the adjacent biasing elements 28, 29 as well as a more or less permanent connection between the eccentric 4 and the diaphragm. Such versatility of the connecting rod 2 and its low cost contribute significantly to the reasonable initial and maintenance cost of the diaphragm pump.

The provision of the carrier 22, especially a carrier which has a relatively long and preferably curved supporting surface 22*a*, exhibits the additional advantage that the orientation of the central portion 26*b* of the diaphragm 26 is not likely to be changed in response to rotation of the output shaft 6 and eccentric 4. In other words, and as explained above, the elongated supporting surface 22*a* reduces the likelihood of tilting of the biasing elements 28 and 29 with reference to the axis of the rivet head 25.

The provision of the recess 15 in the underside of the cover 12 contributes to efficiency of the improved diaphragm pump by reducing the dead space of the pumping chamber PC to a minimum.

The provision of flanges 10 and 12*a*, as well as the utilization of such flanges as a means for sealingly engaging and clamping the marginal portion 26*a* of the diaphragm 26, also contributes to simplicity and reasonable cost of the improved pump. As mentioned above, the relatively thin portion 19 of the flange 10 can be readily flexed so as to surround the adjacent outermost portion of the flange 12*a* and to thus ensure proper retention of the beaded marginal portion 26*a* in the annular groove 51 at the underside of the flange 12*a*.

The aforediscussed mode of connecting the housing 80 of the prime mover PM to the pump housing 1 has been found to be highly advantageous because the connection can be completed by resorting to a relatively small number of fasteners, such as those which are caused to pass through the holes 17 and 18 of the flange 16 on the lower portion 1*a* of the pump housing 1.

The prime mover PM constitutes but one form of means for driving the eccentric 4, i.e., it is clear that the eccentric can receive rotary motion from other types of prime mover means without departing from the spirit of the invention.

The provision of oil sump 8 in the lowermost part of the pump housing portion 1*a* contributes to more reliable operation and longer useful life of the improved diaphragm pump. As a rule, a supply of lubricant in the sump 8 will last for a long period of time. In other words, the provision of plug 7 constitutes a safety feature which is resorted to after long periods of continuous or interrupted use of the improved pump.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a diaphragm pump, the combination of a housing; a flexible diaphragm installed in said housing and including a central portion having an aperture; and means for flexing said diaphragm, comprising a rotary eccentric in said housing, a one-piece elongated connecting rod having an annular first end portion surrounding said eccentric, a carrier remote from said first end portion and a second end portion extending from said carrier and through the aperture of said central portion, a first substantially disc-shaped biasing element having an opening through which said second end portion extends, and a second substantially disc-shaped biasing element having an opening through which said second end portion extends, said second biasing element being disposed between said carrier and said central portion and said central portion being disposed between said biasing elements, said carrier and said second end portion including a part outwardly adjacent to said first biasing element and arranged to urge said biasing elements and said central portion toward said carrier, said carrier having an elongated substantially undulate surface extending substantially transversely of the longitudinal extension of said connecting rod and abutting against said second biasing element.

2. The combination of claim 1, wherein said housing includes a portion defining with said diaphragm a variable-volume pumping chamber and said connecting rod is arranged to flex said diaphragm in first and second directions in response to rotation of said eccentric whereby the diaphragm respectively increases and reduces the volume of said chamber in response to flexing in said first and second directions, and further comprising first and second valve means provided on said housing portion and respectively arranged to open in response to an increase and a reduction of the volume of said chamber.

3. The combination of claim 1, wherein said openings are disposed substantially centrally of the respective biasing elements.

4. The combination of claim 1, wherein said part of said second end portion of said connecting rod constitutes a rivet head.

5. The combination of claim 1, wherein said second end portion fills and thereby seals the opening of said first biasing element.

6. The combination of claim 1, wherein said second end portion fills and thereby seals at least one of said openings.

7. The combination of claim 1, wherein said connecting rod is a stamping.

8. The combination of claim 1, wherein said connecting rod is a preform consisting of sheet metal.

9. The combination of claim 1, wherein said diaphragm has a first side facing said eccentric and a second side adjacent to said first biasing element, said housing comprising a portion adjacent to said second side of said diaphragm and having a recess therein, said connecting rod being arranged to flex said diaphragm between a first end position in which said part of said second end portion extends into said recess and a second end position in which said part is remote from said recess.

10. The combination of claim 1, wherein said housing comprises a first portion and a second portion, said diaphragm further having a marginal portion disposed between said first and second portions of said housing.

11. The combination of claim 10, wherein each of said housing portions has an annular flange and said marginal portion is disposed and sealingly held between said flanges, one of said flanges having a portion surrounding the other of said flanges.

12. The combination of claim 11, wherein said one flange forms part of said first housing portion.

13. The combination of claim 11, wherein said portion of said one flange is thinner than said other flange.

14. The combination of claim 1, wherein said housing includes a portion confining said eccentric and said first end portion of said connecting rod and having an opening, said flexing means further comprising prime mover means including a rotary output member extending through said opening of said housing portion and arranged to rotate said eccentric.

15. The combination of claim 14, wherein said housing portion comprises a flange surrounding said opening thereof and said prime mover means includes a second housing connected with said flange.

16. The combination of claim 15, wherein said flange has an annular recess surrounding the opening of said housing portion and further comprising a deformable sealing element installed in said recess to establish a fluidtight seal between said housings in the region around the opening of said housing portion.

17. The combination of claim 1, wherein said housing includes a portion confining said eccentric and said first end portion of said connecting rod, and further comprising a supply of lubricant in said housing portion.

18. The combination of claim 17, wherein said diaphragm is disposed at a level above said eccentric and said supply of lubricant constitutes an oil sump, said first end portion of said connecting rod and said eccentric dipping into said sump.

19. The combination of claim 17, wherein said housing portion has a port and means for normally sealing said port, said sealing means being removable to allow for admission of lubricant into said housing portion.

* * * * *